US010975324B2

(12) United States Patent
Odink et al.

(10) Patent No.: US 10,975,324 B2
(45) Date of Patent: Apr. 13, 2021

(54) POWDER LUBRICANT BASED ON FATTY ACIDS AND FATTY ACID GLYCERIDES AND USE THEREOF

(71) Applicant: Henkel AG & Co. KGaA, Duesseldorf (DE)

(72) Inventors: Gerrit Jan Odink, Roermond (NL); Amol Chinchole, Groningen (NL)

(73) Assignee: Henkel AG & Co. KGaA, Duesseldorf (DE)

( * ) Notice: Subject to any disclaimer, the term of this patent is extended or adjusted under 35 U.S.C. 154(b) by 152 days.

(21) Appl. No.: 15/970,267

(22) Filed: May 3, 2018

(65) Prior Publication Data

US 2018/0251699 A1 Sep. 6, 2018

Related U.S. Application Data

(63) Continuation of application No. PCT/EP2016/074559, filed on Oct. 13, 2016.

(30) Foreign Application Priority Data

Nov. 4, 2015 (EP) ..... 15193037

(51) Int. Cl.

| | |
|---|---|
| ***F16C 33/04*** | (2006.01) |
| ***C07F 1/00*** | (2006.01) |
| ***C10M 141/02*** | (2006.01) |
| ***C10M 169/00*** | (2006.01) |
| ***C10M 169/04*** | (2006.01) |
| *C10N 10/02* | (2006.01) |
| *C10N 10/04* | (2006.01) |
| *C10N 30/12* | (2006.01) |

(Continued)

(52) U.S. Cl.

CPC ..... *C10M 141/02* (2013.01); *C10M 169/00* (2013.01); *C10M 169/04* (2013.01); *C10M 2207/046* (2013.01); *C10M 2207/126* (2013.01); *C10M 2207/127* (2013.01); *C10M 2207/128* (2013.01); *C10M 2207/1253* (2013.01); *C10M 2207/1256* (2013.01); *C10M 2207/24* (2013.01); *C10M 2207/282* (2013.01); *C10M 2207/289* (2013.01); *C10M 2207/2875* (2013.01); *C10M 2207/40* (2013.01); *C10M 2207/401* (2013.01); *C10M 2207/402* (2013.01); *C10M 2209/104* (2013.01); *C10M 2209/105* (2013.01); *C10M 2209/1045* (2013.01); *C10M 2209/1055* (2013.01); *C10M 2209/12* (2013.01); *C10M 2219/02* (2013.01); *C10M 2219/044* (2013.01); *C10M 2221/041* (2013.01); *C10M 2223/0405* (2013.01); *C10M 2223/045* (2013.01); *C10M 2223/047* (2013.01); *C10N 2010/02* (2013.01); *C10N 2010/04* (2013.01); *C10N 2030/12* (2013.01); *C10N 2030/22* (2020.05); *C10N 2040/243* (2020.05); *C10N 2040/245* (2020.05); *C10N 2050/06* (2013.01); *C10N 2050/08* (2013.01); *C10N 2060/10* (2013.01)

(58) Field of Classification Search

CPC ..... C10M 141/02; C10M 169/00; C10M 169/04; C10M 2207/401; C10M 2223/045; C10M 2219/044; C10M 2207/2875; C10M 2207/127; C10M 2207/128; C10M 2219/02; C10M 2207/125; C10M 2207/28; C10M 2209/103; C10M 2223/0405; C10M 2207/40; C10M 2221/041; C10M 2207/24; C10M 2207/282; C10M 2207/289; C10M 2209/104; C10M 2207/126; C10M 2209/1045; C10M 2209/1055; C10M 2223/047; C10M 2207/046; C10M 2207/1253; C10M 2207/1256; C10N 2260/10; C10N 2250/06; C10N 2250/08; C10N 2240/405; C10N 2240/407; C10N 2240/40; C10N 2210/02; C10N 2230/12; C10N 2210/01; C10N 2230/22

USPC ..... 508/108, 381

See application file for complete search history.

(56) References Cited

U.S. PATENT DOCUMENTS

| | | | |
|---|---|---|---|
| 6,455,476 | B1 | 9/2002 | Imai et al. |
| 6,472,352 | B1 | 10/2002 | Hacias |

(Continued)

FOREIGN PATENT DOCUMENTS

| | | | |
|---|---|---|---|
| CA | 2052604 | A1 | 9/1992 |
| CN | 1662329 | A | 8/2005 |

(Continued)

OTHER PUBLICATIONS

Anonymous, "Castor Oils and Castor Products", Alnor Oil Company Inc., May 6, 2003, XP055245973, Retrieved from the Internet: URL: http://www.alnoroil.com/OilSpecs/CastorChart.pdf, [retrieved on Jan. 29, 2016], 2 pages. Cited in International Search Report for PCT/EP2016/074559.

(Continued)

*Primary Examiner* — Prem C Singh
*Assistant Examiner* — Francis C Campanell
(74) *Attorney, Agent, or Firm* — Mary K. Cameron

(57) ABSTRACT

A dry lubricant composition in powder form is provided based on a mixture of alkali metal salts of fatty acids and fatty acid glycerides which is useful in the production of aluminium cans in a deep drawing process, wherein the formed aluminium cans are immediately further processed to yield thin inorganic and/or organic protective coatings. The invention also encompasses the use of the lubricating powder for cold forming of aluminium as well as a process for the deep drawing of aluminium cans.

17 Claims, No Drawings

(51) Int. Cl.

| | |
|---|---|
| *C10N 30/00* | (2006.01) |
| *C10N 40/20* | (2006.01) |
| *C10N 50/06* | (2006.01) |
| *C10N 50/08* | (2006.01) |
| *C10N 60/10* | (2006.01) |

(56) References Cited

U.S. PATENT DOCUMENTS

| | | | | |
|---|---|---|---|---|
| 2011/0000399 | A1* | 1/2011 | Hauk | C04B 24/08 106/661 |
| 2012/0302472 | A1 | 11/2012 | Litters et al. | |
| 2013/0338049 | A1 | 12/2013 | King et al. | |

FOREIGN PATENT DOCUMENTS

| | | | |
|---|---|---|---|
| DE | 19500267 | A1 | 7/1996 |
| EP | 0034047 | A1 | 8/1981 |
| EP | 0078361 | A1 | 5/1983 |
| EP | 0638116 | B1 | 6/1999 |
| JP | S51115507 | A | 10/1976 |
| JP | S5461380 | A | 5/1979 |
| JP | H3269092 | A | 11/1991 |
| JP | H1153793 | A | 2/1999 |
| JP | 2000063880 | A | 2/2000 |
| SU | 279841 | A1 | 1/1970 |
| WO | 2012132053 | A | 7/2014 |

OTHER PUBLICATIONS

International Search Report for PCT/EP2016/074559, dated Dec. 9, 2016. All references listed in the International Search Report are cited herein.

Runhua Yu Mifeng (1990), (2), pp. 47-49, "Applications of solid lubricants in aluminum-extrusion", Reference could not be located.

Goto, Yoshihiro, et al, "A test for investigating the lubrication properties of solid lubricants in cold metal forming", Journal of Mechanical Working Technology (1982), 6(1), pp. 51-62, Elsevier Scientific Publishing Company, Amsterdam.

Nakamura, Tomotsu, et al, "Effect of solid lubricants in backward extrusion". Synthethic Lubrication (1995), 11(4), pp. 287-294.

* cited by examiner

POWDER LUBRICANT BASED ON FATTY ACIDS AND FATTY ACID GLYCERIDES AND USE THEREOF

The underlying invention consists in a dry lubricant composition in powder form which is especially useful in the production of aluminium cans in a deep drawing process, wherein the formed aluminium cans are immediately further processed to yield thin inorganic and/or organic protective coatings. The lubricating powder is based on a mixture of alkali metal salts of fatty acids and fatty acid glycerides. The invention also encompasses the use of the lubricating powder for cold forming of aluminium as well as a process for the deep drawing of aluminium cans.

Within the can producing industry the deep drawing of aluminium flats is a well-established process. In such a deep drawing process it is necessary to compensate for friction at the contacting areas of the aluminium material and the forming tool, e.g. punches and dies made from hard steel or tungsten carbide. A huge variety of compositions being based on metal soaps is known to support the cold working of metals. The lubricating components are often dispersed or dissolved in a liquid vehicle and thus may form low viscosity liquids or thicker pastes. It is crucial for the effective compensation of friction between the forming tool and the metal to be formed that a thin lubricating film with high uniformity and integrity can be established during the cold forming process. Hence, the homogeneous application of the lubricant is a first prerequisite to achieve successful lubrication. Although the substances with lubricating properties themselves are well-known, it turns out to be difficult to homogeneously apply these substances when contained in a liquid vehicle. Moreover, it is essential to have essentially all volatile material removed before the cold forming step in order to avoid any defects in the metal caused by the flash evaporation of the volatile liquid. On the other hand, the lubricating substances as such, that are mostly solid at room temperature, often raise environmental issues or are by themselves hazardous. Hence, there exists an ongoing need not only to improve the lubricating properties as such but also to improve the applicability as well as to lower the amount of lubricating material needed to perform the cold forming as demanded to meet the specifications of the industry. Another issue consists in the removal of the remainder of the lubricating film on the formed metal surface. Depending on the type of lubricant composition and on the existence of further process steps following the cold forming step, such as painting, the methods of removal may differ essentially and might be selected from purely physical to almost purely chemical treatments.

For example, EP 0638116 B discloses a liquid lubricant composition for the metal working of aluminium that comprises saturated aliphatic monohydric alcohols in an inert volatile liquid organic vehicle. After dipping of the aluminium flat into the liquid lubricant composition, the wet film is dried so that a thin lubricating film is attained that after the cold forming step is removable upon annealing.

US 2012/0302472 A1 discloses a water-resistant lubricating grease based on calcium lignosulfonates additionally comprising calcium soaps and a base oil as a liquid vehicle suitable for constant velocity joint shafts, rolling bearings and gearboxes.

Based on this prior art the objective of this invention consists in establishing a lubricant suitable for the deep drawing of aluminium parts that can be easily applied while less amount of lubricant material is necessary to support the deep drawing process. A further necessity arises from the fact that the deep drawn aluminium parts are often to be coated with protective layers and thus have to be cleaned after the cold forming process. Consequently, a suitable lubricant of this invention shall also have the property to be easy to remove from metal surfaces with conventional aqueous cleaners.

The underlying problem is solved by a lubricating powder comprising a) more than 60 wt.-% of at least one alkali metal salt of a fatty acid, b) at least one fatty acid mono-, di- or triglyceride, wherein the weight ratio of compounds according to component a) to compounds of component b) is not higher than 30.

Such a lubricating powder shows excellent lubricity especially in the deep drawing of aluminium such as the shaping of cylindrical cans from a disc-shaped aluminium sheet. Such deep drawing can be accomplished with comparatively minor amounts of the lubricant. Furthermore, the solids stemming from the lubricating powder that adhere to the surface of the cold formed articles can be easily removed through rinsing with an aqueous cleaner.

Another advantage consists in the applicability of a powder of this invention to the metal flats via conventional means, such as vibrating and tumbling. During said process of applying a powder coating sufficient to support the subsequent deep drawing process, the formation of metal dust upon friction and wear being exerted to the metal flats can be reduced significantly. The reduction of metal dust is desirable to minimize loss of material as well as to ensure minimum metal dust particle content in the respiratory air. In another aspect, the reduction of metal dust also reduces the amount of loose metal particles that adhere to the powder coating and oftentimes effect scratches in the surface of the metal part upon deep drawing and thereby a shorter life time of the punching tool.

A powder according to this invention is to be understood to be a solid mixture comprising at least one pulverised solid while the solid mixture is suitable for pouring. A solid mixture comprised of at least one pulverised solid is usually suitable for pouring when the content of pulverised solids with a softening point below 25° C. is below 5 wt.-% based on the solid mixture. A powder of this invention can be easily adhered to metal parts through vibrating or tumbling of a container inclosing the powder and the metal parts. In a preferred embodiment the lubricating powder being constituted of solid particles has a D50 value of less than 100 μm, preferably less than 60 μm. Nevertheless, it is preferred in order to ensure the formation of a lubricating film with high uniformity and integrity during the cold forming process that the D50 value of the lubricating powder is at least 1 μm, preferably at least 5 μm, more preferably at least 10 μm. The D50 value indicates that that 50 vol.-% of the overall solid particles of the powder have a diameter below the given value. The D50 value can be derived from cumulative particle size distributions being measured with static light diffraction methods and by sieve analysis to measure the portion of solids with particle sizes above 60 μm.

The alkali metal salts according to component a) are preferably selected from lithium, potassium and/or sodium salts, more preferably from sodium salts.

With regard to component a) it is generally preferred that a lubricating powder of this invention comprises C10-C22 fatty acids, more preferably those C10-C22 fatty acids with not more than one unsaturated carbon-carbon double bound, even more preferably saturated C10-C22 fatty acids, and especially preferred alkali metal stearates.

In the context of this invention a C10-C22 or C14-C20 fatty acid contains from 10 to 22 or from 14 to 20 carbon atoms in the longest alkyl chain excluding the carbon atom that constitutes the carboxyl-functionality.

Within a lubricating powder of this invention, the amount of compounds according to component a) is preferably at least 70 wt.-%, more preferably at least 75 wt.-%, even more preferably at least 80 wt.-% in order to establish a powder with high efficiency. The amount of component a) is only limited by the mandatory amount of fatty acid glycerides according to component b) and optional additives that contribute to the overall performance of the lubricating powder so that the amount of compounds according to component a) is preferably below 95 wt.-%, more preferably below 90 wt.-% based on the total composition of the powder.

A certain amount of fatty acid glycerides is mandatory to ensure that such an amount of the powder adheres to the metal part that turns out to be sufficient to form a lubricative film during the deep drawing process. Furthermore, the presence of certain fatty acid glycerides does also help to built-up intensely homogenized lubricative films under the conditions of the deep drawing process, especially when additives conventional in the makeup of lubricants are contained. This behaviour additionally supports the property of the lubricating powders to show excellent lubricative properties under deep drawing conditions as a fusing of the to be formed metal and the forming tool can be prevented due to the homogeneous lubricative coatings attained with the powders of this invention. Nevertheless, with an increasing relative amount of fatty acid glycerides the powder becomes too cloggy, as the particles of the powder tend to agglomerate so that the adherence of the powder to the metal part will deteriorate. Thus, in a preferred embodiment the weight ratio of compounds according to component a) to compounds according to component b) realized in a powder of this invention is at least 6, more preferably at least 8.

Generally, the at least one fatty acid mono-, di- or triglyceride according to component b) of the lubricating powder does also encompass derivatives thereof insofar as the derivative is constituted by a glycerol linked to a fatty acid backbone chain via esterification. Consequently, whenever a fatty acid glyceride according to component b) is referred to herein, said derivatives are by way of definition included. In a preferred embodiment of the lubricating powder, the compounds according to component b) are selected from fatty acid di- or triglycerides, more preferably from fatty acid triglycerides.

More preferably, a lubricating powder of this invention is comprised of compounds according to component b) that are selected from mono-di or triglycerides based on C10-C22 fatty acids, more preferably based on C14-C20 fatty acids, while the glycerides preferably have an iodine value of 50 to 130, more preferably of 70 to 95.

The iodine value in the context of this invention characterizes the amount of carbon-carbon double bounds in a fatty acid glyceride through the amount of iodine in grams being consumed by way of addition reaction per 100 grams of the respective glyceride or mixture of glycerides. The iodine value can be measured according to DIN EN 14111:2003-10 by means of iodometric analysis of a sample being dissolved in chloroform through addition of an excess of Wijs solution (iodine monochloride/acetic acid) wherein the excess of iodine is determined through redox-titration with thiosulfate standard solution.

With regard to absolute amounts of the fatty acid glycerides in a lubricating powder of this invention, at least 2 wt.-%, more preferably at least 4 wt.-%, even more preferably at least 6 wt.-% of the compounds according to component b), preferably of the compounds according to component b) selected from triglycerides, more preferably from triglycerides based on C10-C22 fatty acids, even more preferably from triglycerides based on C14-C20 fatty acids each based on the total composition of the powder are preferred while for each of the selected triglycerides an iodine value of 50 to 130, preferably of 70 to 95, is preferred. Nevertheless, a deterioration of the powder adherence to the surface of aluminium parts can be observed when the amount of component b) is unduly increased. Therefore, it is preferred that the amount of component b) does not exceed 20 wt.-%, more preferably does not exceed 15 wt.-% based on the total composition of the powder.

It is especially preferred, that component b) of the lubricating powder of this invention is comprised of triglycerides based on alkoxylated, preferably ethoxylated and/or propoxylated fatty acids, wherein the degree of alkoxylation is at least 20, more preferably at least 30, but not more than 50, while these triglycerides are preferably based on C10-C22 fatty acids, more preferably based on C14-C20 fatty acids while each of the triglyceride preferably has an iodine value of 50 to 130, more preferably of 70 to 95. In this respect, it is further beneficial for the adherence of the powder to the metal part and the lubricating properties that component b) is additionally comprised of triglycerides based on non-alkoxylated fatty acids with an iodine value of 50 to 130, more preferably of 70 to 95, while these triglycerides are again preferably based on C10-C22 fatty acids, more preferably based on C14-C20 fatty acids.

To fully leverage the positive effect of the presence of these triglycerides based on alkoxylated fatty acids on the yield of lubricating powder that adheres to the metal parts through conventional means of application, such as tumbling, it is preferred that the overall proportion of alkoxylated triglycerides amounts to at least 20 wt.-%, preferably to at least 40 wt.-%, more preferably to at least 60 wt.-% based on the total amount of compounds according to component b).

A lubricating powder of this invention inherently also possess the property of being a suitable basic recipe to which further components can be added that are either useful to further boost lubricative properties or to confer other beneficial properties such as cleanability to the processed metal parts or such as a reduced tendency for dust formation to the powder itself.

To this effect, the lubricating powder may additionally comprise at least one alkali metal lignosulfonate as component c), preferably in an amount of at least 0.1 wt. %, at least 0.2 wt.-%, but preferably less than 5 wt. % based on the total composition of the powder. Lignosulfonates stem from the sulfonation of lignins being a natural biopolymer derived from wood. As such, lignosulfonates are a byproduct from the production of wood pulp using sulfite pulping. These lignosulfonates further improve the adherence of the powder to the metal parts and thereby the efficiency of the powder application as such.

Preferred lignosulfonates within a lubricating powder of this invention reveal a weight average molecular weight of at least 2,000 g/mol, but preferably not more than 20,000 g/mol, more preferably not more than 10,000 g/mol.

The alkali metal ions of component c) are preferably selected from lithium, potassium and/or sodium ions, preferably from sodium ions.

Furthermore, the lubricating powder of this invention may additionally comprise as a component d) at least one compound known to the skilled person to be an "extreme pressure additive". These additives release low molecular weight compounds selected from *sulphurous* and phosphorous compounds during the cold forming process under tribological wear and thereby also prevents from fusing of the to be formed metal and the forming tool. In addition, extreme pressure additives in the context of this invention were found to additionally support that lubricating powders were attained that possess less tendency to form dust. The reduction of dust formation is desirable to ensure minimum dust particle content in respiratory air when the lubricating powder is handled to be applied to the metal parts. Preferred extreme pressure sensitives as component d) are selected from sulfides, polysulfides and/or dialkyldithiophosphates, preferably from dialkyldithiophosphates with not more than 12 carbon atoms in each alkyl chain, most preferably from sodium and/or zinc dialkyldithiophosphates with not more than 12 carbon atoms in each alkyl chain.

In a lubricating powder of this invention component d) preferably amounts to at least 1 wt.-%, more preferably to at least 2 wt.-%, but preferably does not contain more than 8 wt.-%, more preferably not more than 5 wt.-% based on the total composition of the powder.

The powder lubricant of this invention may also comprise as component e) a minor amount of organic compounds that are conventionally used solvents. These solvents may also assist in adherence to the metal parts but mainly improve to yield a homogenous loading of the powder on the metal flats. Most solvents do also have an impact on the cleanability of the deep-drawn metal parts by way of wet chemical treatment so that only a few solvents are acceptable. An organic solvent in the context of this invention has a molecular weight of less than 1,000 g/mol. Considering all these properties being influencing by the presence of a solvent, a lubricating powder is preferred that additionally comprises as component e) at least one organic solvent being preferably selected from organic compounds consisting of elements selected from hydrogen, oxygen and carbon and preferably having an $E_T(30)$ value of at least 158 kJ/mol. Surprisingly it was found that cleanability of the deep-drawn metal parts can be improved when the organic solvent being selected from organic compounds consisting of elements selected from hydrogen, oxygen and carbon has an $E_T(30)$ value of at least 180 kJ/mol such as mono- or diglycol ethers with not more than 12 carbon atoms. The $E_T(30)$ value is a measure for the polarity of a solvent. Said value can be experimentally deduced from the spectroscopic measurement of the long-wavelength intramolecular charge-transfer absorption band of Reichardt's pyridinium-N-phenolate betaine dye ("Betaine 30") being dissolved in the respective solvent at 25° C. and 1 atm.

Some specific embodiments of the lubricating powder of this invention that additionally comprise alkylene diamines being acylated by fatty acids turn out to be useful to decrease abrasive wear in specific deep drawing applications. It thus may be preferable to add as component f) of alkylene diamines being acylated by fatty acids that accord with component a) as defined earlier, most preferably N,N'-ethylenebis(stearamide), to a lubricating powder of this invention. Nevertheless, the component f) preferably does not amount to more than 20 wt.-%, more preferably not more than 10 wt.-%, based on the total composition of the lubricating powder of this invention.

As already indicated only a minor amount of organic solvents is tolerable since otherwise the powder becomes cloggy and adherence will deteriorate. Consequently, the amount of solvents according to component e) is preferably at least 1 wt.-%, more preferably at least 2 wt.-%, but preferably less than 10 wt.-%, more preferably less than 8 wt.-%, especially preferred less than 5 wt.-% based on the total composition of the powder of this invention.

It was surprisingly found that the lubricity of a powder solely based on salts of fatty acids and fatty acid glycerides is sufficient for deep drawing purposes and that there exists no need to add a significant amount of Lewis-Acids such as zinc, aluminium or calcium cations to increase the lubricity. To the contrary, such powders that contain a significant amount of polyvalent cations such as zinc cations tend to result in lubricative coatings that are difficult to remove from the deep-drawn aluminium parts and thereby require a more vigorous cleaning compared to cleaning methods conventional in the art for industrial customers of deep-drawn metal parts. For this reason, it is beneficial that a lubricating powder of this invention does preferably contain less than 5 wt.-%, preferably less than 1 wt.-% of zinc cations, preferably of polyvalent cations, based on the total composition of the powder.

The lubricating powder of this invention preferably comprises less than 2 wt.-%, preferably less than 1 wt.-%, more preferably less than 0.1 wt.-% of free fatty acids.

Another aspect of this invention consists in the use of a lubricating powder as described herein for the cold forming of aluminium parts, especially for the deep drawing of aluminium.

One major advantage of the underlying invention consists in a high coating efficiency of the lubricating powder material compared to lubricating liquids or pastes. This advantage is especially important in processes where a multitude of metal parts has to be coated with a lubricating composition in a short period of period, such as in the beverage can producing industry.

Consequently, the underlying invention also encompasses a process for the production of aluminium cans comprising the subsequent steps of a) placing a multitude of aluminium flats and a lubricating powder of this invention in one container, preferably barrel, wherein the lubricating powder preferably amounts to not more than 20 grams, more preferably not more than 10 grams, but preferably amounts to at least 1 gram each per square meter of the surface of the aluminium flats;

b) vibrating or tumbling the container, preferably barrel, in order to coat the aluminium flats with a lubricating film of the powder lubricant;

c) deep-drawing of the aluminium flats into cans through punching, preferably impact extrusion; and optionally d) cleaning and degreasing of the aluminium cans, preferably with a water-based cleaner.

In a preferred embodiment of this process the cans are of cylindrical shape and the aluminium flats are in the shape of discs.

EXAMPLES

Different powder lubricants of this invention (Table 1) have been applied to aluminium discs prior to the forming cylindrical thin walled aluminium cans through impact extrusion.

A thin layer of this lubricant was applied to the surface of aluminium discs with a diameter of 74 mm and a thickness of 6 mm by tumbling a specific amount of lubricant powder so that a theoretical loading of 7.8 grams per square meter of the aluminium discs was given. The tumbling was performed for 20 minutes at 15-22 rpm.

The lubricated discs were then subjected to impact extrusion to form the body of a can with a defined length L of the cylindrical axis and wall thickness W of the can (L=259 mm; W=0.74 mm). For this specific type of cold forming a horizontal impact extrusion press was used. The punch and the die were made of tungsten carbide. Each lubricant powder of Table 1 gave rise to a successful punching so that the desired shape without material failure was attained and no significant undulations with regard to the wall thickness were observed.

Table 2 shows that reasonable good adherence of the powder to the aluminium discs is achieved for all powder lubricants. Nevertheless, it is evident that lubricants based on fatty acid salts of zinc reveal the poorest loading yield after tumbling as well as the poorest cleanability of the aluminium cans after punching (see V1). The use of a sodium stearate in combination with a fatty acid glyceride gives always rise to good loading yields above 80% (see E1-E4). The cleanability is still also governed by the presence and type of solvents used while the lubricant that contains diethylene glycol monobutyl ether having a $E_T(30)$ value of above 180 kJ/mol is easy to clean with a mild alkaline cleaner (see E2 vs E3). The same solvent is also beneficial to attain a very homogenous appearance of the powdered discs (see E2 vs E1).

TABLE 1

| Lubricant Powder Compositions | V1 wt.-% | E1 wt.-% | E2 wt.-% | E3 wt.-% | E4 wt.-% |
|---|---|---|---|---|---|
| Component a) | | | | | |
| zinc stearate | 68 | — | — | — | — |
| sodium stearate | 17 | 85 | 86.8 | 86.8 | 86.8 |
| Component b) | | | | | |
| glycerol trioleate | — | 5 | 3 | 3 | — |
| ethoxylated castor oil (40 EO) | — | 5 | 3.9 | 3.9 | 5.3 |
| Component c) | | | | | |
| sodium lignosulfonate | 10 | 2.5 | 0.3 | 0.3 | — |
| Component d) | | | | | |
| butylated triphenyl phosphate ester | 2.5 | — | — | — | 5.3 |
| zinc dialkyl dithiophosphate | 2.5 | — | 2 | 2 | 2.6 |
| Component e) | | | | | |
| diethylene glycol monobutyl ether | — | — | 4 | — | — |
| mixture of dimethyl glutarate/dimethylsuccinate | — | — | — | 4 | — |

TABLE 2

| Test Results | V1 | E1 | E2 | E3 | E4 |
|---|---|---|---|---|---|
| Efficiency | | | | | |
| Yield/% [1] | 57 | 100 | 95 | 88 | 85 |
| Cleanability [2] | ⊙ | + | + | X | N/A |
| Adherence [3] | + | + | + | + | + |
| Dust formation [4] | X | + | + | + | N/A |

TABLE 2-continued

| Test Results | V1 | E1 | E2 | E3 | E4 |
|---|---|---|---|---|---|
| Appearance | | | | | |
| Staining [5] | S | SM | S | S | S |

[1] determined based on weight difference of 20 Al discs before and after tumbling
[2] dip alkaline cleaning (8 wt.-% Bonderite CAK 509; Fa. Henkel AG) for 2 min at 70° C:
⊙ poor, significant amount of residual powder
X difficult, some amount of residual powder
+ easy, no residual powder
[3] assessed visually after powdered disc was dropped with his shell on a black metal plate from a height of 10 cm
⊙ poor, most of powder fell off
X sufficient, some powder fell off
+ good, almost no powder fell off
[4] assessed after tumbling
⊙ significant
X visible
+ not visible
[5] visual assessment of diameter of stains after tumbling
L large (>10 mm)
M medium (5-10 mm)
SM small to medium (2-5 mm)
S small (<2 mm)

What is claimed is:

1. A lubricating powder comprising:

a) more than 60 wt.-% of at least one alkali metal salt of a fatty acid, b) at least one fatty acid mono-, di- or triglyceride, wherein the lubricating powder has a weight ratio of compounds according to component a) to compounds according to component b) that is not greater than 30, wherein component b) is selected from mono-, di-, tri-glycerides and combinations thereof which are based on C10-C22 fatty acids, while the glycerides have an iodine value of 50 to 130.

2. A lubricating powder comprising:

a) more than 60 wt.-% of at least one alkali metal salt of a fatty acid, b) at least one fatty acid mono-, di- or triglyceride, wherein the lubricating powder has a weight ratio of compounds according to component a) to compounds according to component b) that is not greater than 30, wherein component b) comprises triglycerides based on alkoxylated fatty acids having a degree of alkoxylation of at least 20, but not more than 50.

3. The lubricating powder according to claim 1, wherein the at least one alkali metal salt of a fatty acid is selected from alkali metal salts of C10-C22 fatty acids having not more than one unsaturated carbon-carbon bond.

4. The lubricating powder according to claim 2, wherein the at least one alkali metal salt of a fatty acid is selected from stearates.

5. The lubricating powder according to claim 2, wherein compounds according to component a) are present in an amount of at least 70 wt.-%, but less than 95 wt.-% based on the total composition of the lubricating powder.

6. The lubricating powder according to claim 1, wherein compounds according to component a) are present in an amount of at least 75 wt.-%, but less than 90 wt.-% based on the total composition of the lubricating powder.

7. The lubricating powder according to claim 1, wherein component b) is selected from said diglycerides, triglycerides and combinations thereof; and wherein component b) further comprises triglycerides based on alkoxylated fatty acids having a degree of alkoxylation of at least 20, but not more than 50.

8. The lubricating powder according to claim 1, wherein component b) is selected from mono-, di-, tri-glycerides and combinations thereof which are based on C14-C20 fatty acids, while the glycerides have an iodine value of 70 to 95.

9. The lubricating powder according to claim 2, wherein component b) further comprises triglycerides based on non-alkoxylated fatty acids with an iodine value of 80 to 100 g $I_2$/100 g.

10. The lubricating powder according to claim 9, wherein overall proportion of alkoxylated triglycerides amounts to at least 20 wt.-% based on the total amount of compounds according to component b).

11. The lubricating powder according to claim 2, wherein compounds according to component b) are present in an amount of at least 2 wt.-%, but not more than 20 wt.-%, based on the total composition of the lubricating powder.

12. The lubricating powder according to claim 2, further comprising component c) at least one alkali metal lignosulfonate present in an amount of at least 0.1 wt.-%, but less than 5 wt.-% based on the total composition of the lubricating powder.

13. A lubricating powder comprising:

a) more than 60 wt.-% of at least one alkali metal salt of a fatty acid, b) at least one fatty acid mono-, di- or triglyceride, and c) at least one alkali metal lignosulfonate present in an amount of at least 0.1 wt. %, but less than 5 wt. % based on the total composition of the lubricating powder wherein the lubricating powder has a weight ratio of compounds according to component a) to compounds according to component b) that is not greater than 30, wherein component a) comprises alkali metal salts of saturated C10-C22 fatty acids; component a) being present in an amount of at least 70 wt.-%, but less than 90 wt.-% based on the total composition of the lubricating powder; and component b) comprises:

1) triglycerides based on alkoxylated fatty acids having a degree of alkoxylation of at least 20, but not more than 50; and 2) triglycerides based on non-alkoxylated fatty acids based on C14-C20 fatty acids;

component b) being present in an amount of at least 4 wt.-%, but not more than 20 wt.-% based on the total composition of the powder.

14. The lubricating powder according to claim 13, further comprising component d) at least one extreme pressure additive present in an amount of 1 to 8 wt.-% based on the total composition of the lubricating powder.

15. The lubricating powder according to claim 14, further comprising component e) at least one organic solvent present in an amount of at least 1 wt.-%, but less than 10 wt.-%, based on the total composition of the lubricating powder.

16. A method of using a lubricating powder according to claim 13, comprising applying the lubricating powder to aluminum material prior to cold forming of aluminum parts.

17. A process for producing aluminum cans comprising steps of:

a) placing a multitude of aluminum flats and a lubricating powder according to claim 2 in one container;

b) vibrating or tumbling the container to thereby coat the aluminum flats with a lubricating film of the lubricating powder;

c) deep-drawing the aluminum flats into cans through punching; and optionally d) cleaning and degreasing of the aluminum cans.

* * * * *